US006716111B2

(12) United States Patent
Liberatore

(10) Patent No.: US 6,716,111 B2
(45) **Date of Patent: *Apr. 6, 2004**

(54) WEIGHT HOLDER FOR ATTACHMENT TO GOLF CLUB HEAD

(76) Inventor: Raymond A. Liberatore, 12143 Punkin Hollow Rd., Bentonville, AR (US) 72713

( * ) Notice: Subject to any disclaimer, the term of this patent is extended or adjusted under 35 U.S.C. 154(b) by 0 days.

This patent is subject to a terminal disclaimer.

(21) Appl. No.: 10/160,925

(22) Filed: May 30, 2002

(65) Prior Publication Data

US 2003/0125123 A1 Jul. 3, 2003

Related U.S. Application Data

(63) Continuation-in-part of application No. 09/988,862, filed on Nov. 21, 2001, now Pat. No. 6,652,387, which is a continuation-in-part of application No. 09/799,913, filed on Mar. 5, 2001, now Pat. No. 6,443,851.

(51) Int. Cl.[7] ..... A63B 69/36

(52) U.S. Cl. ..... 473/256; 273/DIG. 30; 150/160

(58) Field of Search ..... 473/256, 231, 473/242, 219, 206, 238, 437, 553; 273/DIG. 30; 150/160; 206/315.4

(56) References Cited

U.S. PATENT DOCUMENTS

| | | | | | |
|---|---|---|---|---|---|
| 1,674,136 | A | | 6/1928 | Shidler | |
| D169,880 | S | | 6/1953 | Williams | |
| 2,676,803 | A | | 4/1954 | Damaske | |
| 2,737,394 | A | | 3/1956 | Abel | |
| 3,072,167 | A | * | 1/1963 | Banas | 150/160 |
| 3,145,749 | A | | 8/1964 | Rosenow | |
| 3,231,281 | A | | 1/1966 | Wallo | |
| 3,398,961 | A | | 8/1968 | Higdon | |
| 3,593,769 | A | | 7/1971 | Spears | |
| 3,938,570 | A | * | 2/1976 | Stewart | 150/160 |
| 4,119,129 | A | * | 10/1978 | Freiberg | 150/160 |
| 4,213,614 | A | | 7/1980 | Philippi | |
| 4,588,191 | A | * | 5/1986 | Stewart | 473/256 |
| 4,602,788 | A | | 7/1986 | Wendt | |
| 4,842,280 | A | | 6/1989 | Hilton | |
| 5,000,238 | A | | 3/1991 | Zeller | |
| 5,230,512 | A | | 7/1993 | Tattershall | |
| 5,294,127 | A | | 3/1994 | Keelan | |
| 5,403,009 | A | | 4/1995 | Gleason, Jr. | |
| 5,527,038 | A | | 6/1996 | Mabie | |
| 5,609,531 | A | | 3/1997 | Gates | |
| 5,615,720 | A | | 4/1997 | O'Sullivan | |
| 5,776,006 | A | | 7/1998 | Gruber | |
| 6,015,354 | A | | 1/2000 | Ahn et al. | |
| 6,065,516 | A | | 5/2000 | Chang | |
| 6,083,116 | A | | 7/2000 | Loredo | |
| 6,102,810 | A | | 8/2000 | Boland | |
| 6,120,385 | A | | 9/2000 | Nemeckay | |
| 6,126,556 | A | | 10/2000 | Hsieh | |
| 6,443,851 | B1 | * | 9/2002 | Liberatore | 473/256 |
| 6,461,249 | B2 | * | 10/2002 | Liberatore | 473/256 |
| 6,652,387 | B2 | * | 11/2003 | Liberatore | 473/256 |

* cited by examiner

*Primary Examiner*—Sebastiano Passaniti
(74) *Attorney, Agent, or Firm*—William W. Haefliger

(57) ABSTRACT

A weighting device for use on the head of a golf club during practice swinging of the club, comprising in combination, a receptacle having an opening via which the club head is received into the receptacle, a flexible retainer carried on the receptacle to be fastened at least partly covering the opening and then extending over one side of the receptacle, for retaining the receptacle to the club head, and weighting structure carried by the receptacle to add substantial weight to the club head weight, for use as in club head swinging. The head typically is a golf club wood head.

28 Claims, 8 Drawing Sheets

WEIGHT HOLDER FOR ATTACHMENT TO GOLF CLUB HEAD

This application is a continuation-in-part U.S. application Ser. No. 09/988,862, filed Nov. 21, 2001, now U.S. Pat. No. 6,652,387, which is a continuation-in-part of pending U.S. application Ser. No. 09/799,913, filed Mar. 5, 2001 now U.S. Pat. No. 6,443,851.

BACKGROUND OF THE INVENTION

This invention relates generally to swinging of golf clubs, as for example woods; and more particularly concerns removably adding weight to the club head, such as at a selectable location or locations proximate the head.

When golfers warm-up, or train, they commonly use two clubs, such as irons, and swing them in unison a few times to loosen muscles. Holding and swinging two clubs is awkward, uncomfortable, and does not achieve the right feel, needed as by gripping and swinging only one club; but one club does not achieve additional weight as can be provided by two clubs. There is need to overcome this dilemma, in a simple, effective and efficient manner, as is now provided by the present invention, which is particularly applicable to metal woods, or wooden woods.

SUMMARY OF THE INVENTION

It is a major object of the invention to provide a simple and effective weighting device meeting the above need, for golf clubs. Basically, the device comprises:

a) a receptacle having an opening via which the club head is received into the receptacle, with the hosel projecting from that opening, b) a flexible retainer carried on the receptacle to be fastened in a position at least partly covering that opening, and then extending over a surface of the receptacle, for retaining the receptacle to the club head, c) and weighting structure carried by the receptacle to add substantial weight to the club head, for providing enhanced momentum in the direction of head swinging, and for use as in club swinging, d) the head being a golf club wood head.

As will be seen, the retainer preferably comprises a flap or strap carried to extend at least part way over or about the receptacle, when closed on a wood club head, and hook and pile fastening material such as VELCRO may be provided to adhere the flap or strap in fastening position. The retainer may advantageously comprise two flaps to be extending in different positions wrapping at least part way about the receptacle. The flaps in such positions may typically overlie the top of the wood head.

Another object includes provision of a receptacle having at least two of the following:

i) a wall portion to extend adjacent the front face of the club head ii) a wall portion to extend adjacent the rear side of the club head iii) a wall portion to extend adjacent the bottom surface of the club head iv) a wall portion to extend adjacent the toe of the club head v) a wall portion to extend adjacent the heel of the club head vi) a wall portion to extend adjacent the top surface of the club head;

and the weighting structure is located at or proximate at least one of such wall portions.

In addition, the weighting structure typically includes metallic material, solid or flowable; it is typically concealed by the receptacle; and it may include separate localized metallic portions. It may be sewn or otherwise held in a pocket or pockets provided by the receptacle, and at opposite sides of a club head retained in the receptacle.

Yet another object includes location of the weighting material in a pocket provided by the receptacle, the pocket sized to enable adjustment of the position of the material, relative to the pocket; and in this regard the pocket or pockets may enable selective use of the material in one or more pockets, for adjustable weighting, as to positioning, or as to selected weighting, or both. The pocket may be sized to fit different or all sizes of heads.

Another object includes provision of two retainer flaps having fold portions located at opposite sides of the hosel. Such flaps, prior to being wrapped at least part way about the receptacle, extend in diverging relation away from said receptacle opening.

A further object includes provision of two flaps wrapping about portions of the retainer proximate the hosel, and the flaps having end portions one of which overlies the other, at the upper side of the wood, there being hook and pile material retaining the flaps in fastened position.

A further object is to provide a receptacle as for reception, and safe retention to, of any golf club head, wedge head, putter head, or other head; and for use of the receptacle on a head as a swing trainer, or to cure a slice or hook; or to help "release" of the club during warm-up; or to increase golfer muscle strength or flexibility and/or to improve tempo, and/or swing speed, and/or wrist action.

These and other objects and advantages of the invention, as well as the details of illustrative embodiments, will be more fully understood from the following specification and drawings, in which:

DRAWING DESCRIPTION

Figure 3:
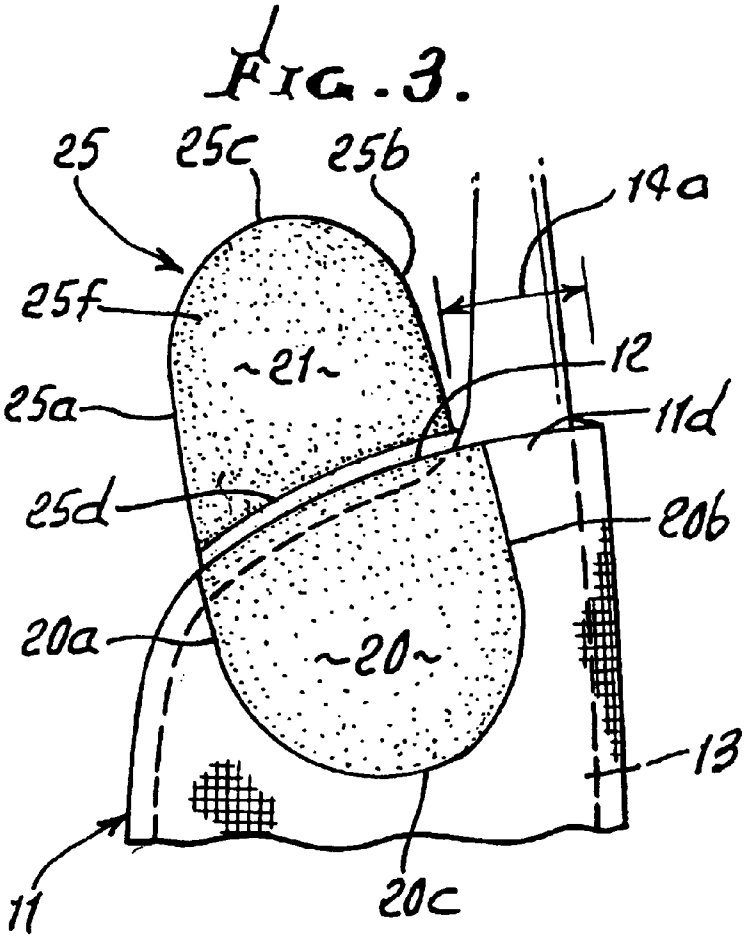
Figure 2:
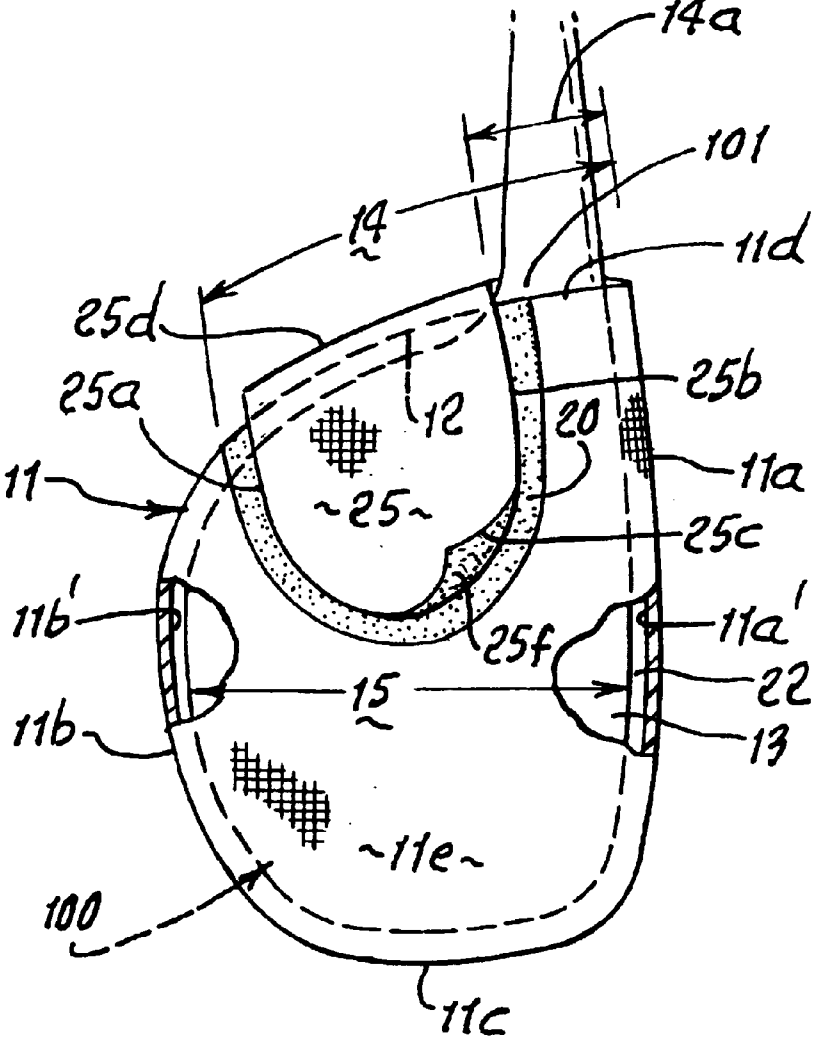
FIG. 2 is a top plan view of the FIG. 1 device.
Figure 2A:
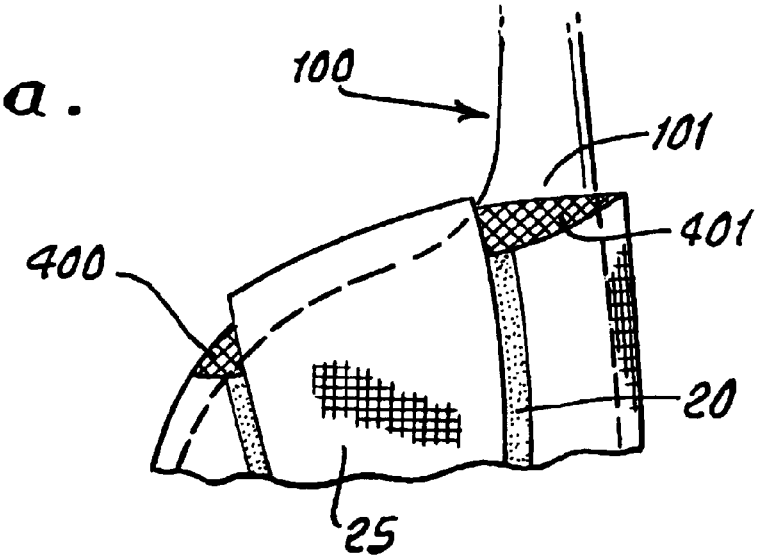
Figure 4:
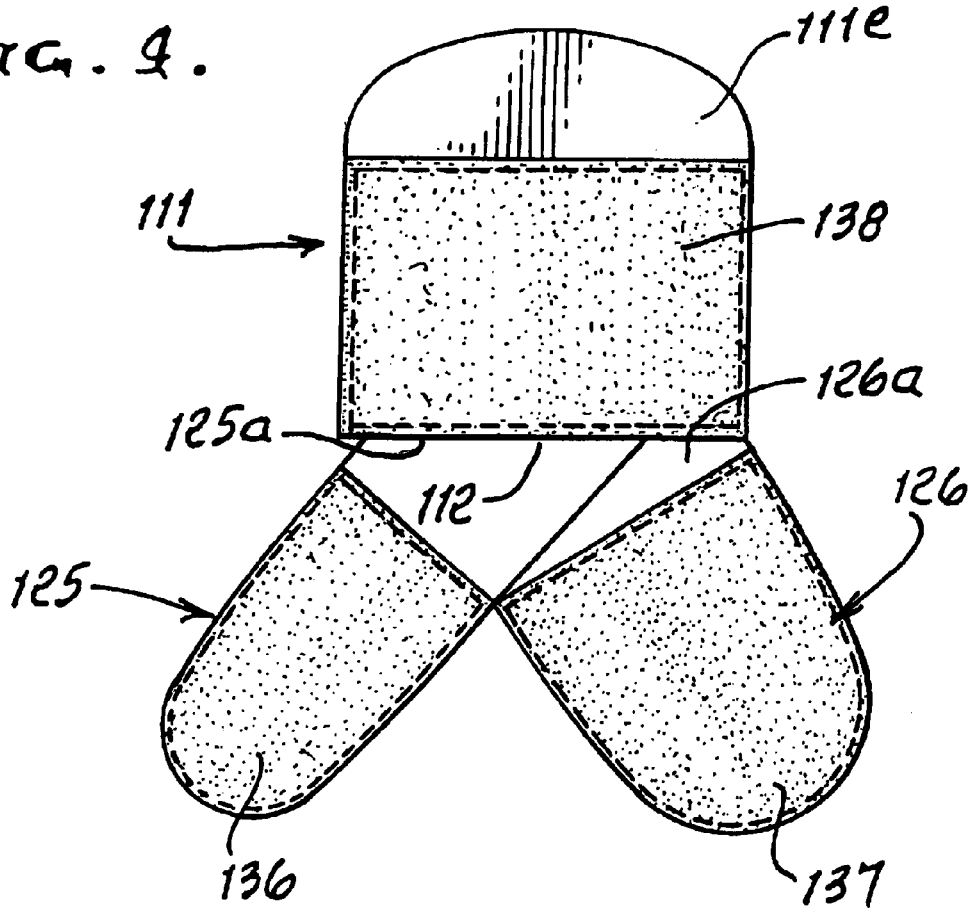
Figure 5:
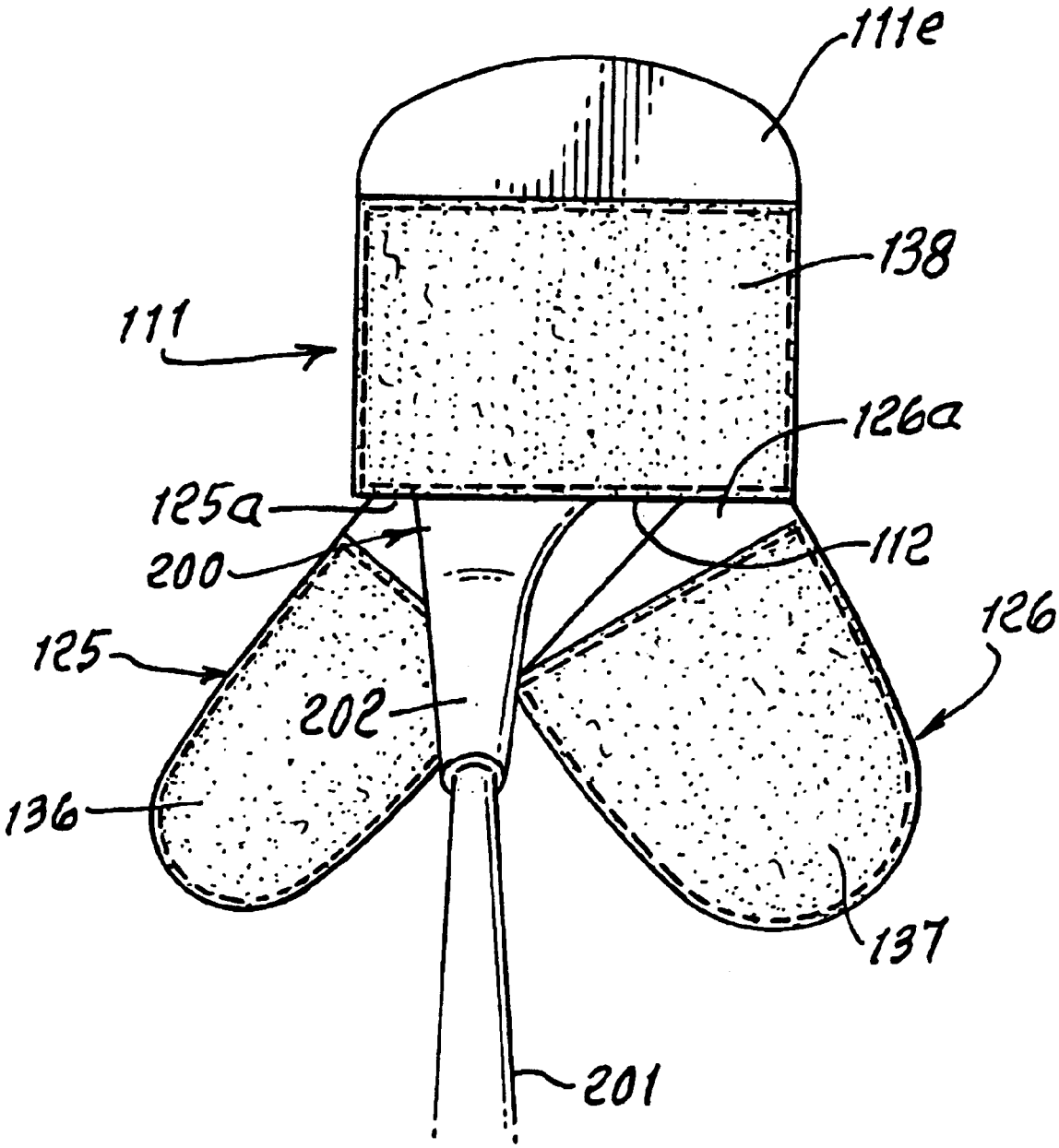
Figure 7:
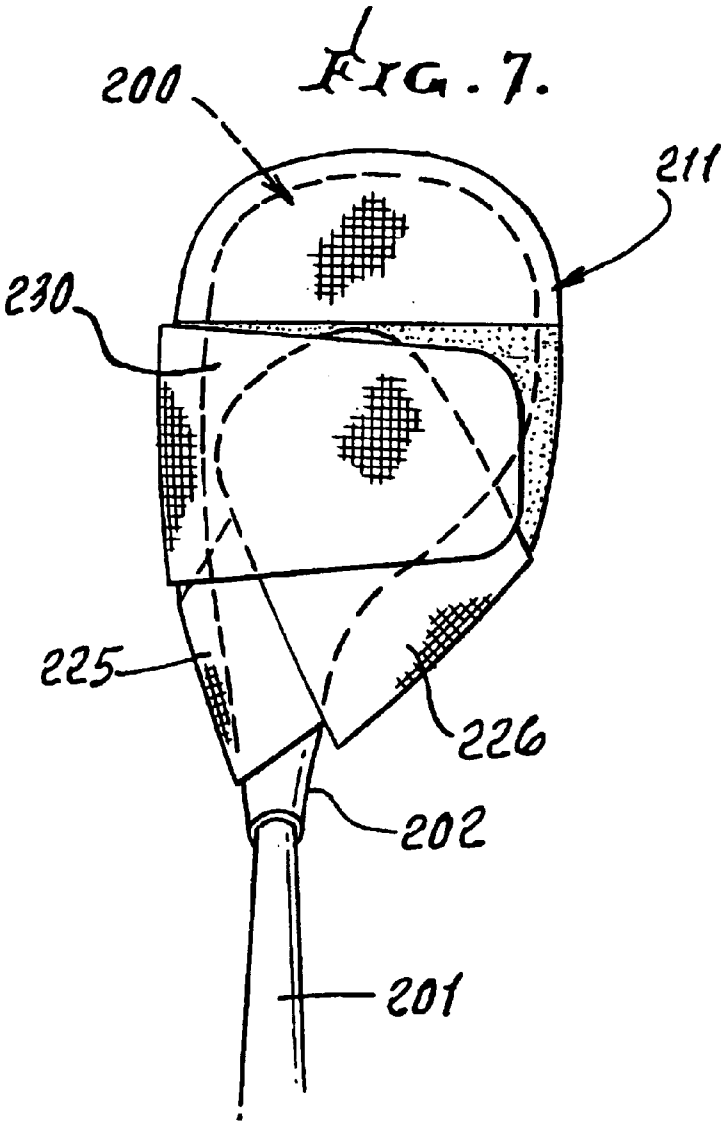
Figure 6:
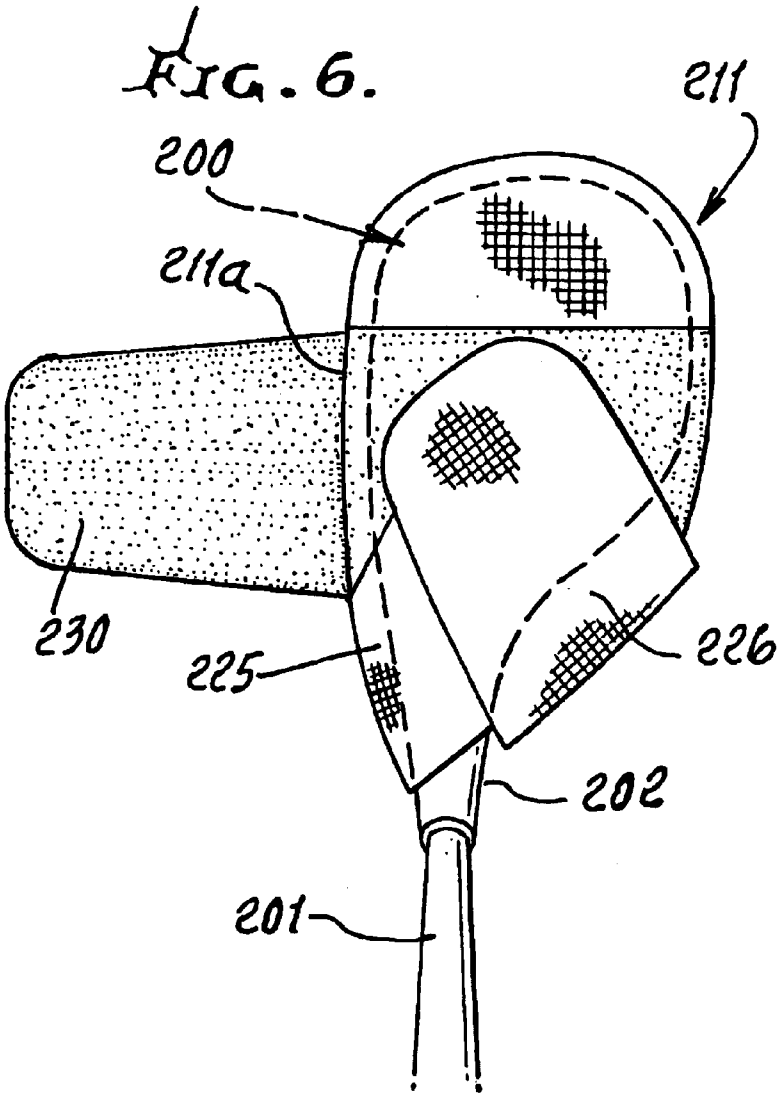
Figure 8:
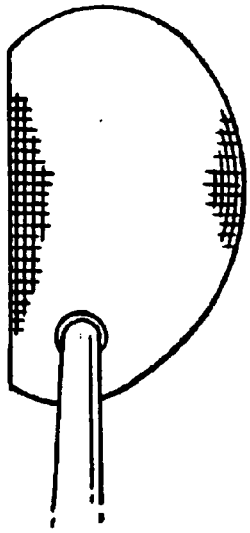
Figure 9:
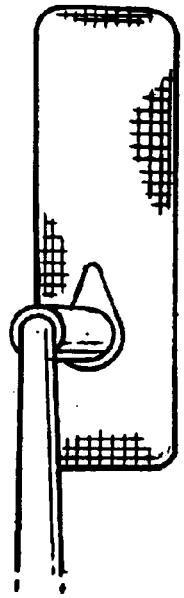
Figure 10:
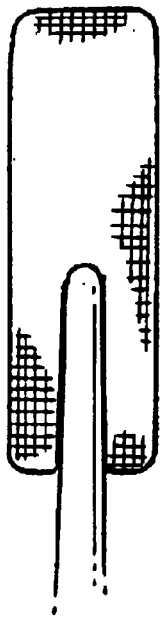
Figure 11:
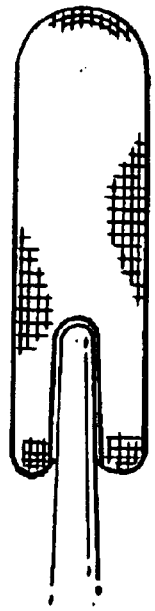
Figure 12:
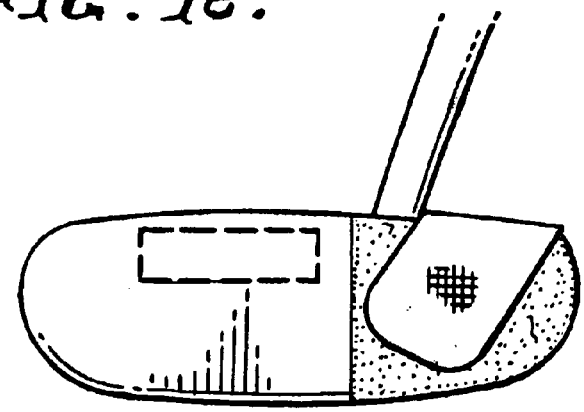
Figure 13:
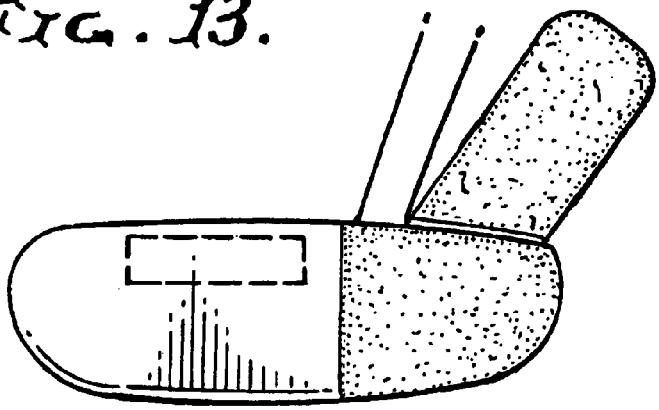
Figure 14:
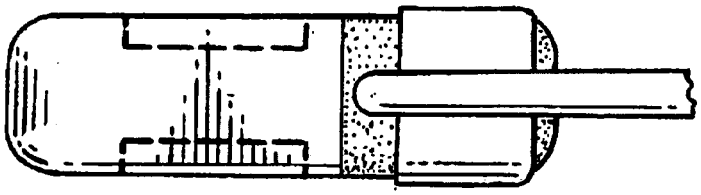
Figure 15:
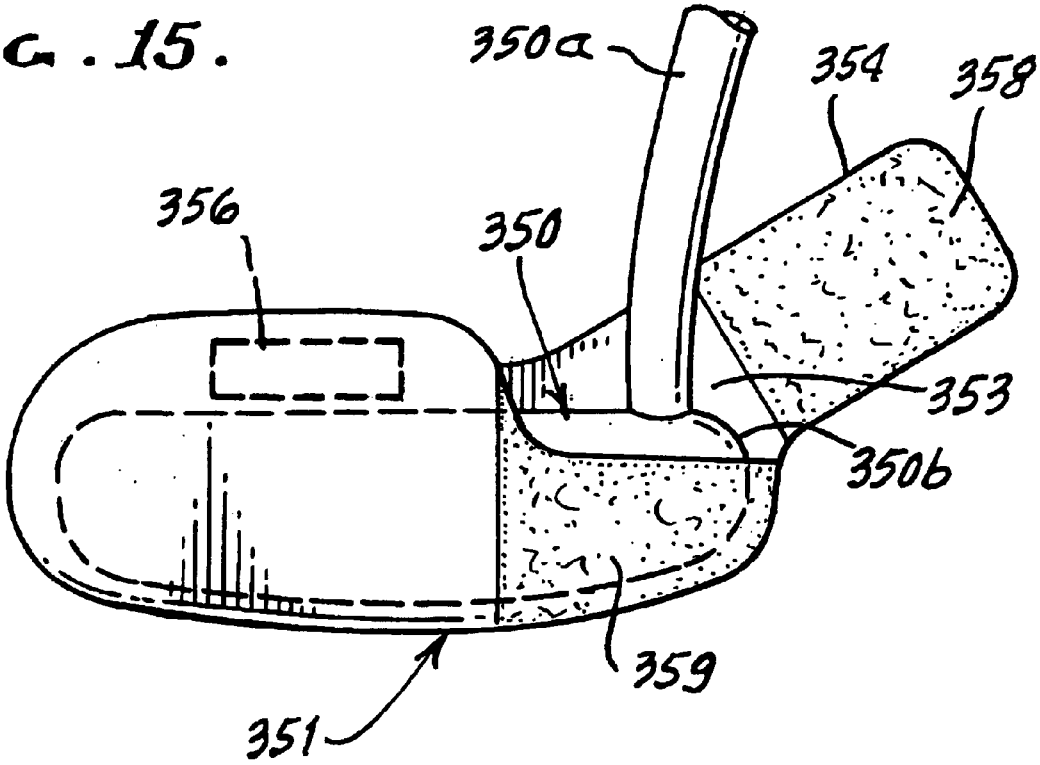

FIG. 2*a* is a modification of FIG. 2;

FIG. 3 is a view like FIG. 2, but showing a retainer flap in opened position, i.e. folded back away from the top of the receptacle;

FIG. 4 is a schematic top plan view of a modified receptacle having two retainer flaps;

FIG. 5 is a view like FIG. 4, but showing reception of a golf club wood head into the FIG. 4 receptacle;

FIG. 6 is a schematic top plan view of a further modified receptacle having three flaps, the third flap in open position and the first two flaps in folded and closed positions;

FIG. 7 is a view like FIG. 6, but showing all three flaps in closed positions;

FIGS. 8–11 are top plan views of weight carrying receptacles applied to putters;

FIG. 12 is a frontal view of a putter head received in a weight carrying receptacle, having a closed retainer flap;

FIG. 13 is a view like FIG. 12, showing the retainer flap in open position;

FIG. 14 is a top plan view of the FIG. 12 assembly;

FIG. 15 is a side elevation showing receptacle retention to a putter; and

Figure 16:
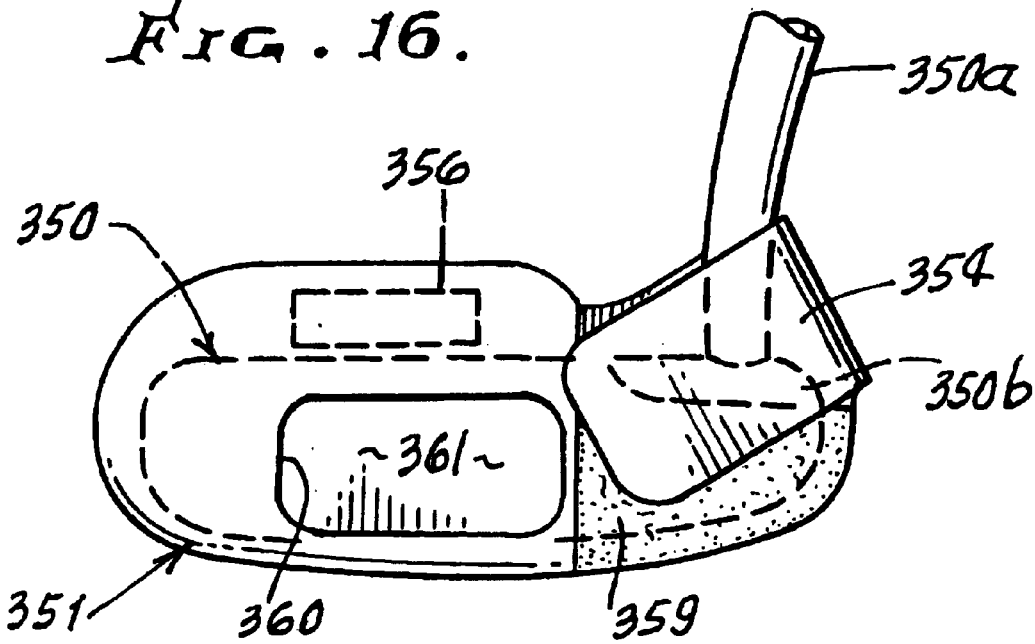

FIG. 16 is a view like FIG. 15 showing flap closure.

DETAILED DESCRIPTION

Figure 1:
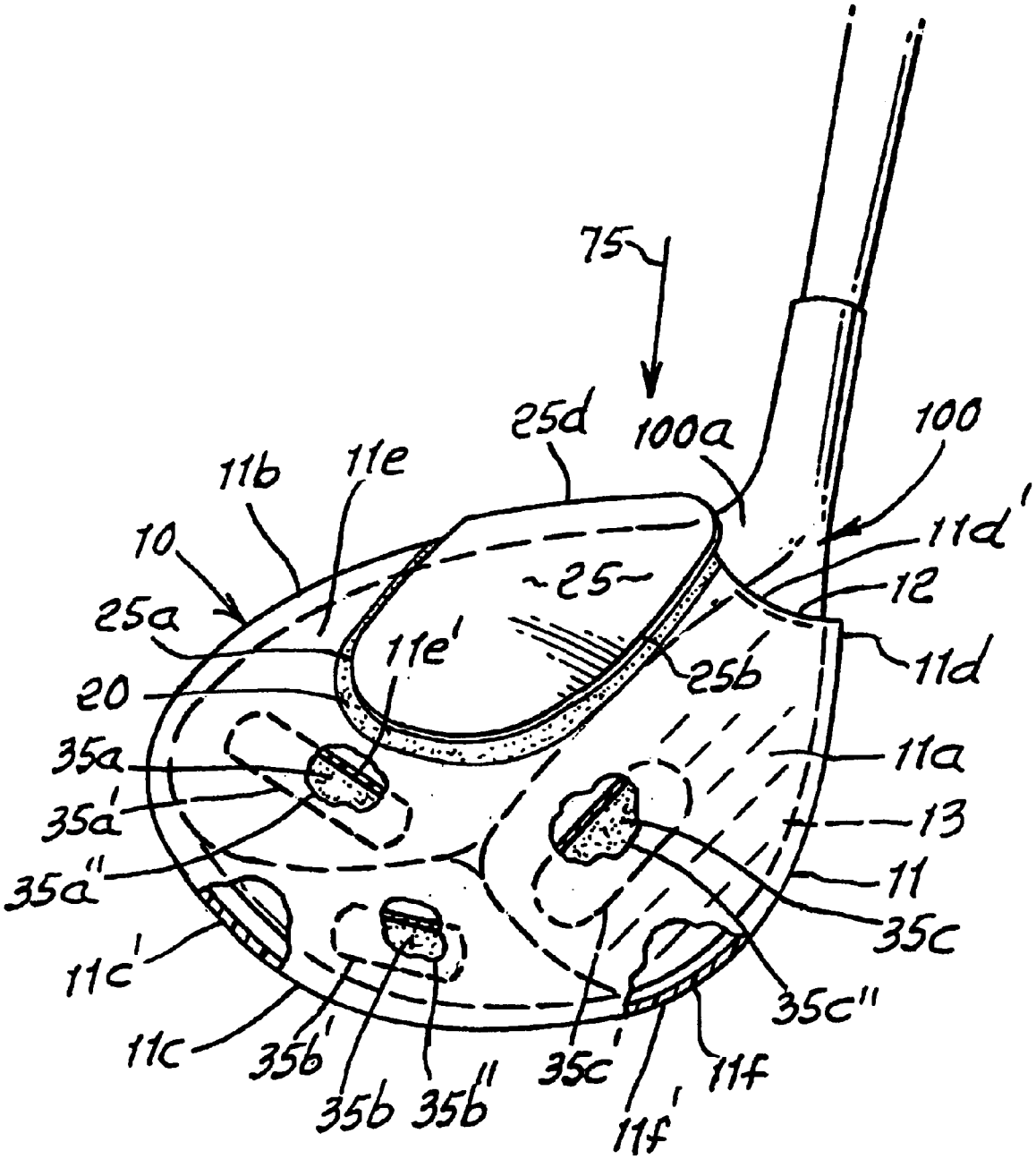
FIG. 1 is a perspective view of a weighting device receptacle, as attached to a golf club wood head.

Referring to FIGS. 1–3, a weight holder device is shown at 10, for use on a golf club 100 as during warm-up swinging of the club. The club may for example be a wood head 13. The device 10 includes a receptacle 11 having an opening 12 via which, or through which golf club head 13 is received into the receptacle in direction 75. The receptacle has a front side 11*a*, a rear side 11*b*, a toe end 11*c*, a heel end at 11*d*, a top 11*e*, and a bottom 11*f*. In this example, and referring to FIG. 3 the opening 12 extends at the heel end 11*d*, and may have a long dimension indicated at 14 in FIG. 2. That dimension widens to be typically greater than the maximum width dimension 15 of the head when the top 11*e* is pushed toward bottom 11*f* to allow entry of the head, endwise, through the opening, and into the receptacle, as well as removal from the receptacle. The receptacle typically consists of flexible fabric or material which is tough and durable, as for example synthetic resinous (plastic) material.

The receptacle preferably has wall portions, and typically at least two of the following:

i) a front side or first inner wall portion 11*a*' associated with 11*a* to extend adjacent, or proximate the face of the golf club head;

ii) a rear side or second wall portion 11*b*' associated with 11*b* to extend adjacent or proximate the club head rear side, iii) a lower or third wall portion 11*f*' associated with 11*f* to extend adjacent the broad bottom surface of the club head;

iv) a forward or fourth wall portion 11*c*' associated with 11*c* to extend forwardly of or adjacent the toe of the club head;

v) a rearward or fifth wall portion 11*d*' associated with 11*d* to extend adjacent or proximate the heel of the club head;

vi) a top or sixth wall portion 11*e*' associated with 11*e* to extend adjacent or proximate the top surface of the club head;

The receptacle further defines an interior chamber or slot 22 receiving the club head 13.

As will be seen, a retainer is carried on the receptacle to be extended and fastened in a position for safely retaining the receptacle in close fitting relation to the club head, preventing release or separation of the retainer, during club swinging.

In the example, a retainer in the form of a flap 25 is shown in open position in FIG. 3, and in closed, lowered position in FIGS. 1 and 2. The flap is or may be integral with the rear side wall portion of the receptacle, and has side edges 25*a* and 25*b*, and rearward angled edge 25*c*. When folded downwardly at fold zone 25*d*, side edge 25*b* folds closely adjacent the hosel upper surface zone 100*a* of a received club head (wood), and then downwardly adjacent the top 11*e*, of the receptacle as indicated in FIG. 1 and FIG. 2. The flap inner surface 25*f* may be retained to receptacle top 11*e* as by hook and pile attachment, enabling easy opening and closing of the flap, and its adjustable closing of the opening 12, as well as tightening to closely fit the receptacle to the club head, while at the same time providing very firm attachment of the device to a club head, prevents loosening and/or detachment, as during club swinging. The flap fits closely over the top of the head, near the hosel, to retain the receptacle to the head, and closing the opening 12, to have reduced width 14*a*.

Hook or pile structure 20 typically but not necessarily extends over a substantial extent of the receptacle top 11*e*, so that the pile or hook structure 21 on the flap can be adjustably attached to 20 in selected positions (tightened or loosened) toward or away from selected edges 20*a*, 20*b*, and 20*c*, considering the different sizes of different wood heads to be protectively confined. Therefore, versatility of the device is enhanced. The majority of opening 12 is covered by the flap in FIGS. 1 and 2.

Further in accordance with the invention, weighting structure (as for example metallic weight or weights) is carried by the receptacle to add substantial weight to the head weight, for use in club swinging.

The weighting structure is so carried that it is located at or proximate one of the following:

vii) at least one of such wall portions;

viii) at least two of such wall portions;

ix) at least three of such wall portions;

x) at least four of such wall portions.

In FIGS. 1–3, the weighting structure includes three metallic (steel for example) weights 35*a*, 35*b*, and 35*c* located in pockets 35*a*', 35*b*' and 35*c*' at the top, toe, and front walls of the receptacle. Such pockets may be formed by pocket fabric material at the inner sides of the top, toe and front wall portions at 16, 17 and 18 to position weight 35–37 as shown. See the cutaways, at 35*a*", 35*b*" and 35*c*". The thickness of each weight is typically less than its length, and less than its width, as shown. The pockets may consist of flexible fabric and may be closed to hold the weights in positions, as described, and sewn to the receptacle.

Weight material may consist of metallic granules, or pebbles, or non-metallic material such as sand.

FIG. 2*a* shows the use of receptacle elasticized material 400 and 401 at an edge or edges of the receptacle opening 12, and tending to reduce the size of that opening, to hug the club head proximate the hosel area 101.

FIGS. 4 and 5 schematically show a receptacle 111, generally like that of FIGS. 1–3, with the corresponding elements bearing the same numerals. Two retainer flaps 125 and 126 are shown, and which diverge away from each other in folded back open position as seen in FIGS. 4 and 5. The flaps have ends 125*a* and 126*a* attached to the bottom wall of the receptacle, near wide opening 112. FIG. 5 shows a club wood head 200 partly inserted into the receptacle via opening 112. The club shaft and hosel are seen at 201 and 202. FIG. 6 shows the flaps in closed position extending at least partially over the top 111*e* of the receptacle, via criss-cross relation. VELCRO (hook or pile) material 136 and 137 on the flaps attaches to hook or pile material 138 on receptacle to 111*e* to firmly hold the receptacle to the recessed club (wood) head 200. VELCRO may also interconnect the top of flap 125 to the underside of flap 126. The flaps extend closely at opposite sides of the narrowed hosel 202, to close opening 112 portions at opposite sides of the hosel, locking the receptacle to the head. Weighting material may be carried by the receptacle, at the regions referred to in FIGS. 1–3.

FIGS. 6 and 7 show a modified receptacle 211, like that of FIGS. 4 and 5, and having retainer flaps 225 and 226 corresponding to 125 and 126. A third flap 230 is added to extend at the front side of the receptacle, i.e. away from first wall 211*a*, in flap open position. In third flap closed position (see FIG. 7) it folds back, or extends, upwardly adjacent the front side of the receptacle, and over the top of the receptacle, as for example over the tops of the folded flaps 225 and 226, to be retained in position by hook and pile material.

FIG. 15 shows a putter head 350 received in a receptacle 351 via an opening 353 at the rear of the receptacle. The putter shaft 350*a* projects upwardly from the opening 353, and a retention flap 354 projects at the rear of the receptacle. Weights 356 are provided within the receptacle, and at the top of the putter head. FIG. 16 shows the flap now wrapped about the rear 350*b* of the head to close opening 353, and projecting forwardly adjacent the front side of the receptacle. VELCRO may be provided at 358 and 359 to attach the flap to the front side of the receptacle.

An opening 360 can be provided in that front side of the receptacle to expose the ball striking face of the putter, as at sweet spot 361, to enable putting use of the putter, while the weighted receptacle is in place. The weights provide inertial directivity during stroking. A similar front opening can be provided in the receptacle seen in FIGS. 1 and 2.

I claim:

1. A weighting device in combination with and for use on the head of a golf club as during swinging of the club, the club having a hosel and a toe, comprising in combination:

a) a receptacle having an opening via which the club head is received into the receptacle, with the hosel projecting from said opening, b) a flexible retainer carried on the receptacle to be fastened in a position at least partly covering said opening, and then extending over a surface of the receptacle, for retaining the receptacle to the club head, c) and weighting structure carried by the receptacle to add substantial weight to the club head, for providing enhanced momentum in the direction of head swinging, and for use as in club swinging, d) said head being a golf club wood head, e) said retainer in said position overlying the top of the club head, and extending bodily forwardly toward said toe, generally parallel to the top of the club head, and generally toward but spaced from said weighting structure, in said fastened position.

2. The combination of claim 1 including hook and pile fastening material for fastening said retainer in said position.

3. The combination of claim 2 wherein said retainer comprises a flap to be extended at least part way over or about the receptacle.

4. The combination of claim 1 wherein said retainer comprises a flap to be extended at least part way over or about the receptacle.

5. The combination of claim 4 wherein said flaps in said positions overlie the top of said wood head.

6. The combination of claim 1 wherein said retainer comprises two flaps to be extending in different positions wrapping at least part way over or about the receptacle.

7. The combination of claim 6 including, the two flaps having fold portions located at opposite sides of the hosel.

8. The combination of claim 6 wherein said flaps prior to being wrapped at least part way about the receptacle, extend in diverging relation away from said receptacle opening.

9. The combination of claim 8 including hook or pile layers on portions of the flaps remote from the receptacle.

10. The combination of claim 1 wherein said receptacle has at least two of the following:

i) a wall portion to extend adjacent the front face of the club head, ii) a wall portion to extend adjacent the rear side of the club head, iii) a wall portion to extend adjacent the bottom surface of the club head, iv) a wall portion to extend adjacent the toe of the club head, v) a wall portion to extend adjacent the heel of the club head, vi) a wall portion to extend adjacent the top surface of the club head, and said weighting structure is located at or proximate at least one of said wall portions.

11. The combination of claim 10 wherein said weighting structure is located at or proximate one of the following:

vii) at least one of said wall portions, viii) at least two of said wall portions, ix) at least three of said wall portions, x) at least four of said wall portions.

12. The combination of claim 11 wherein said weighting structure includes separate local metallic portions.

13. The combination of claim 1 wherein said weighting structure includes one of the following:

a) metallic material, b) flowable metallic material, c) non-metallic material, d) flowable non-metallic material.

14. The combination of claim 13 wherein said material is concealed by said receptacle.

15. The combination of claim 13 wherein said material is held in a pocket or pockets provided on the receptacle.

16. The combination of claim 13 wherein said material is received in pockets adjacent sides of the club head.

17. The combination of claim 13 wherein said material is received in a pocket provided by the receptacle, the pocket sized to enable adjustment of the position of the material, relative to the pocket.

18. The combination of claim 13 wherein the material is received in a pocket or pockets provided by the receptacle, to enable selective weight usage of the pocket or pockets of the material.

19. The combination of claim 1 including the retainer having at least one flexible flap or one flexible opening positioned to retain the receptacle to a narrowed portion of the club head at or near the hosel.

20. The combination of claim 19 wherein the retainer comprises two flaps wrapping about portions of the retainer proximate the hosel, and the flaps having end portions one of which overlies the other, at the upper side of the wood head, there being hook and pile material retaining the flaps in fastened position.

21. The combination of claim 1 including an elastic zone or zones associated with the receptacle and acting to resiliently reduce the size of the opening.

22. The combination of claim 1 wherein the receptacle has a front opening to expose a face zone of the club head, for striking a golf ball.

23. The combination of claim 1 wherein said weighting structure is located at a receptacle toe portion.

24. A weighting device in combination with and for use on the head of a golf club as during swinging of the club, the club having a hosel and a toe, comprising in combination:

a) a receptacle having an opening via which the club head is received into the receptacle, with the hosel projecting from said opening, b) a flexible retainer carried on the receptacle to be fastened in a position at least partly covering said opening, and then extending over one side of the receptacle, for retaining the receptacle to the club head, c) and weighting structure carried by the receptacle to add substantial weight to the club head, for providing inertial directivity of club head swinging, d) said head being a golf putter head, e) said retainer being foldable and having a free end portion folded downwardly along said side of the receptacle, to also project toward said toe.

25. The combination of claim 24 including hook and pile fastening material for fastening said retainer in said position.

26. The combination of claim 24 wherein the receptacle has a front opening exposing a face zone of the putter head, for striking a golf ball.

27. The combination of claim 24 wherein said club includes a putter shaft extending generally upwardly from said opening and the receptacle including a closure flap wrapping over a portion of said opening at the rear of the shaft.

28. The combination of claim 27 wherein said weighting structure is positioned above said putter head in the receptacle.

* * * * *